US012623818B2

(12) United States Patent
Kim et al.

(10) Patent No.: US 12,623,818 B2
(45) Date of Patent: May 12, 2026

(54) CONTENT CONTAINER

(71) Applicant: YONWOO CO., LTD., Incheon (KR)

(72) Inventors: Min Goo Kim, Incheon (KR); Dae Seok Yu, Incheon (KR); Mun Wan Cho, Incheon (KR); Seok Gi Choi, Incheon (KR)

(73) Assignee: YONWOO CO., LTD., Incheon (KR)

( * ) Notice: Subject to any disclaimer, the term of this patent is extended or adjusted under 35 U.S.C. 154(b) by 146 days.

(21) Appl. No.: 18/699,091

(22) PCT Filed: Oct. 7, 2022

(86) PCT No.: PCT/KR2022/015095

§ 371 (c)(1),
(2) Date: Apr. 5, 2024

(87) PCT Pub. No.: WO2023/063651

PCT Pub. Date: Apr. 20, 2023

(65) Prior Publication Data

US 2024/0336409 A1 Oct. 10, 2024

(30) Foreign Application Priority Data

Oct. 13, 2021 (KR) ..... 10-2021-0136176

(51) Int. Cl.
*B65D 47/06* (2006.01)
*A45D 34/04* (2006.01)
*B65D 47/12* (2006.01)

(52) U.S. Cl.
CPC ..... *B65D 47/061* (2013.01); *A45D 34/04* (2013.01); *B65D 47/122* (2013.01)

(58) Field of Classification Search
CPC ..... B65D 41/04; B65D 43/02; B65D 47/06; B65D 47/061; B65D 47/18; B65D 47/20; B65D 47/122; A45D 34/04; A45D 40/26
(Continued)

(56) References Cited

U.S. PATENT DOCUMENTS 10,753,485 B2 * 8/2020 Kang ..... B05B 11/1069
2003/0155379 A1 * 8/2003 Masuzzo ..... B05B 11/1001 222/321.7

(Continued)

FOREIGN PATENT DOCUMENTS

JP S51-098249 U 8/1976
JP S53-161958 U 12/1978

(Continued)

*Primary Examiner* — Luan K Bui

(74) *Attorney, Agent, or Firm* — Bridgeway IP Law Group, PLLC; Sang Ho Lee; Hyun Woo Shin

(57) ABSTRACT

A content container is provided according to one embodiment of the present invention. The content container includes: a container body accommodating content; a neck portion which is formed on the upper end of the container body and has an opening portion formed therein, the opening portion being in communication with the inside of the container body; and a discharge portion which is at least partially accommodated in the neck portion so as to seal the opening portion and has a nozzle portion for discharging the content, on the upper portion thereof. The discharge portion has at least one communication hole formed in the lower end thereof, for transferring the content in the container body to the nozzle portion. When the discharge portion is descended from a first position to a second position by the external force of a user, the communication hole is exposed to the inside of the container body so that the content in the container body can be transferred to the nozzle portion via the communication hole.

9 Claims, 8 Drawing Sheets

(58) Field of Classification Search
USPC ..... 222/321.7, 321.8, 321.9, 322, 539
See application file for complete search history.

(56) References Cited

U.S. PATENT DOCUMENTS

| | | | | |
|---|---|---|---|---|
| 2011/0278328 | A1* | 11/2011 | Kang | B05B 11/1023 222/321.2 |
| 2014/0231465 | A1* | 8/2014 | Choi | B05B 11/0059 222/321.9 |
| 2019/0323614 | A1* | 10/2019 | Kang | F16K 7/17 |

FOREIGN PATENT DOCUMENTS

| | | | |
|---|---|---|---|
| JP | H07-112749 | A | 5/1995 |
| JP | H10-230960 | A | 9/1998 |
| JP | 6553863 | B2 | 7/2019 |
| KR | 10-2021-0044670 | A | 4/2021 |
| KR | 10-2021-0094426 | A | 7/2021 |
| KR | 10-2304176 | B1 | 9/2021 |
| WO | 2020/198655 | A1 | 10/2020 |

* cited by examiner

CONTENT CONTAINER

TECHNICAL FIELD

The present invention relates to a content container, and more specifically, to a content container, which can tightly seal the contents in a locked state and release the locked state by simply rotating an overcap to allow the contents to be discharged.

BACKGROUND ART

In general, a dropper-type cosmetic container is configured to allow a discharge portion having a pipette to be detachably attached to a container. A dropper-type cosmetic container, in a state in which the pipette is inserted into the container, is implemented to suck and discharge the contents when a user presses a button. Alternatively, a tube-type cosmetic container, in a state in which a pipette-shaped nozzle is coupled to one end thereof, is implemented to discharge the contents through the nozzle when the user directly presses the container.

The cosmetic containers can suck and directly discharge a small amount of contents to an application area, and minimize exposure of the contents to the external environment during storage and use, so are widely adopted for containers for functional cosmetics such as serum, essence, and eye cream.

However, in a case in which functional substances prone to chemical changes due to external environments, such as retinol, vitamins, etc., are included in the contents, since the contents may be deteriorated due to exposure to light, oxygen, moisture, etc., during the distribution, storage, and other processes of cosmetic containers, the dropper-type cosmetic cosmetic containers have a limitation in that it is insufficient to protect the contents from being deteriorated by external environments.

Therefore, there is a demand for technology to solve the problem.

DISCLOSURE

Technical Problem

Accordingly, the present invention has been made in view of the above-mentioned problems occurring in the related art, and it is an objective of the present invention to provide a content container, which can tightly seal the contents in a locked state and release the locked state by simply rotating an overcap to allow the contents to be discharged.

The objectives of the present invention are not limited to those mentioned above, and other objectives not mentioned herein will be clearly understood by those skilled in the art from the following description.

Technical Solution

To accomplish the above-mentioned objects, according to the present invention, there is provided a content container including: a container body accommodating contents; a neck portion which is formed on the top of the container body and has an opening portion formed therein to communicate with the inside of the container body; and a discharge portion, of which at least a portion is accommodated in the neck portion so as to seal the opening portion, and which has a nozzle portion formed at the upper portion thereof to discharge the contents, wherein the discharge portion has at least one communication hole formed in the bottom of the discharge portion to transfer the contents of the content container to the nozzle portion, and when the discharge portion descends from a first position to a second position by an external force of a user, the communication hole is exposed to the inside of the container body so that the contents in the container body can be transferred to the nozzle portion via the communication hole.

Moreover, the communication hole is positioned above the opening portion in the first position of the discharge portion to be blocked from the inside of the content container, and when the discharge portion descends to the second position, the communication hole is positioned below the opening portion to communicate with the inside of the container body.

Furthermore, on the outer side of the bottom of the discharge portion, at least one first coupling protrusion and at least one second coupling protrusion are respectively formed on the bottom and the top of the communication hole to be spaced apart from each other, and coupling grooves corresponding to the first and second coupling protrusions are formed on the inner surface of the opening portion. The first coupling protrusion is coupled to the coupling groove in the first position of the discharge portion such that the communication hole is located above the opening portion, and the second coupling protrusion is coupled to the coupling groove in the second position of the discharge portion such that the communication hole is located below the opening portion.

In addition, the content container further includes a shoulder portion coupled to the outer side of the neck portion to fix the discharge portion to the neck portion, wherein as the shoulder portion rotates in the first direction, the discharge portion descends with the shoulder portion.

Additionally, at least one rotation prevention protrusion is formed on the outer surface of the bottom of the neck portion to prevent the shoulder portion from rotating in the second direction opposed to the first direction.

Moreover, the content container further includes an overcap coupled to the top of the shoulder portion to cover the nozzle portion to shield the nozzle portion, wherein when the overcap is rotated in the first direction, the shoulder portion rotates with the overcap in the first direction.

Furthermore, when the overcap is rotated in the second direction, the overcap is separated from the shoulder portion.

Additionally, at least one retaining protrusion is formed on the inner bottom surface of the shoulder portion, and the rotation prevention protrusion forms a slope surface on the outer side as the protrusion height of the rotation prevention protrusion increases in the first direction. When the shoulder portion is rotated in the second direction, the retaining protrusion is caught to the first-direction end of the rotation prevention protrusion, thereby preventing rotation of the shoulder portion in the second direction.

In addition, the retaining protrusion is formed in such a way that the protrusion height of the retaining protrusion increases in the second direction.

Moreover, the content container further includes a stopper portion placed between the neck portion and the shoulder portion to cover the neck portion, thereby preventing the descent of the shoulder portion due to the first-direction rotation.

Advantageous Effect

According to the present invention, the content container can prevent leakage and deterioration of the contents by effectively sealing the neck portion and/or the container body through the discharge portion in the locked state.

Additionally, according to the present invention, the content container can lower the discharge portion just by rotating the overcap in one direction to release the locked state, thereby increasing the convenience of manipulation for the user.

DESCRIPTION OF DRAWINGS

A brief description of each drawing is provided for better understanding of the drawings referred to in the detailed description of the present invention.

MODE FOR INVENTION

Figure 1:
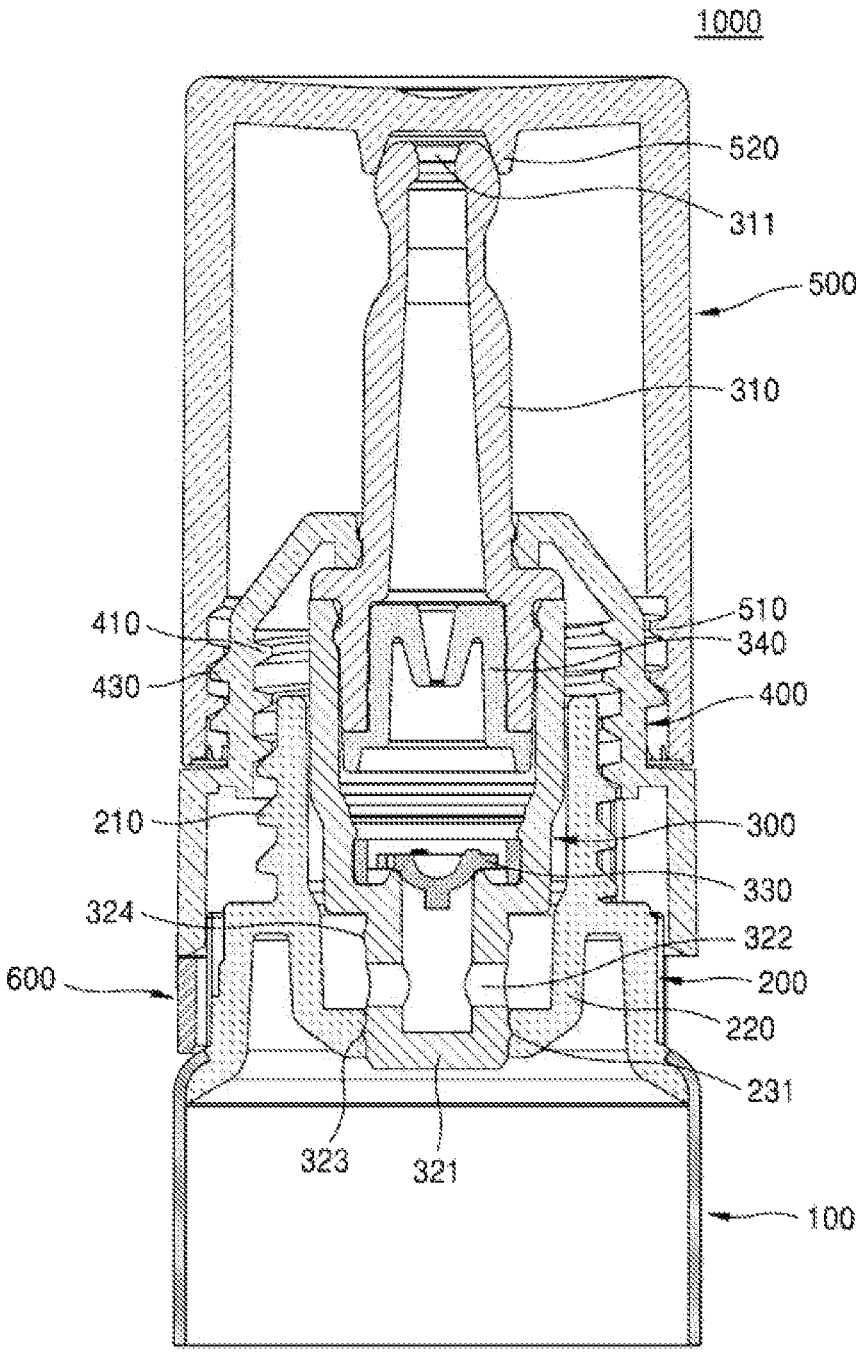
FIG. 1 is a cross-sectional view of a content container according to an embodiment of the present invention.

Hereinafter, exemplary embodiments of the present invention will be described with reference to the accompanying drawings. In the following description, the same components will be designated by the same reference numerals although they are shown in different drawings. Furthermore, in the following description of the present invention, a detailed description of known functions and configurations incorporated herein will be omitted when it may make the subject matter of the present invention rather unclear. In addition, a preferred embodiment of the present invention will be described hereinbelow, the technical thought of the present invention is not restricted or limited thereto and may be embodied in various manners through modification by those skilled in the art. For convenience, directions such as top, bottom, left, and right mentioned below are based on the drawings, and it should be noted that the scope of the present invention is not necessarily limited by the directions.

Throughout the specification, when one part is "connected" to another part, it includes not only being "directly connected" but also being "indirectly connected" with another component in between. Moreover, when one part "includes" another component in the specification, it means that the part includes other components unless specifically stated otherwise, rather than excluding other components. Furthermore, in describing components of the embodiment of the present invention, terms such as first, second, A, B, (a), (b), etc., may be used. The terms are used to distinguish the components from other components, and the essence, order, or sequence of the components is not limited by the terms.

Figure 2:
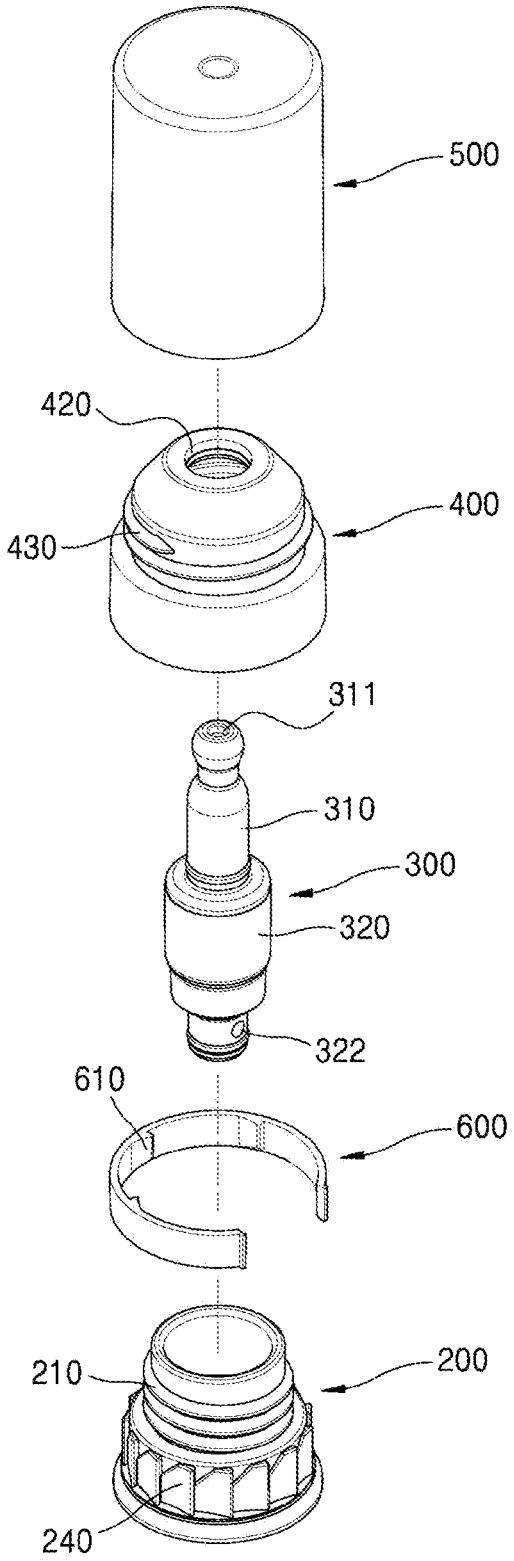
FIG. 2 is an exploded perspective view of the content container according to the embodiment of the present invention.
Figure 3:
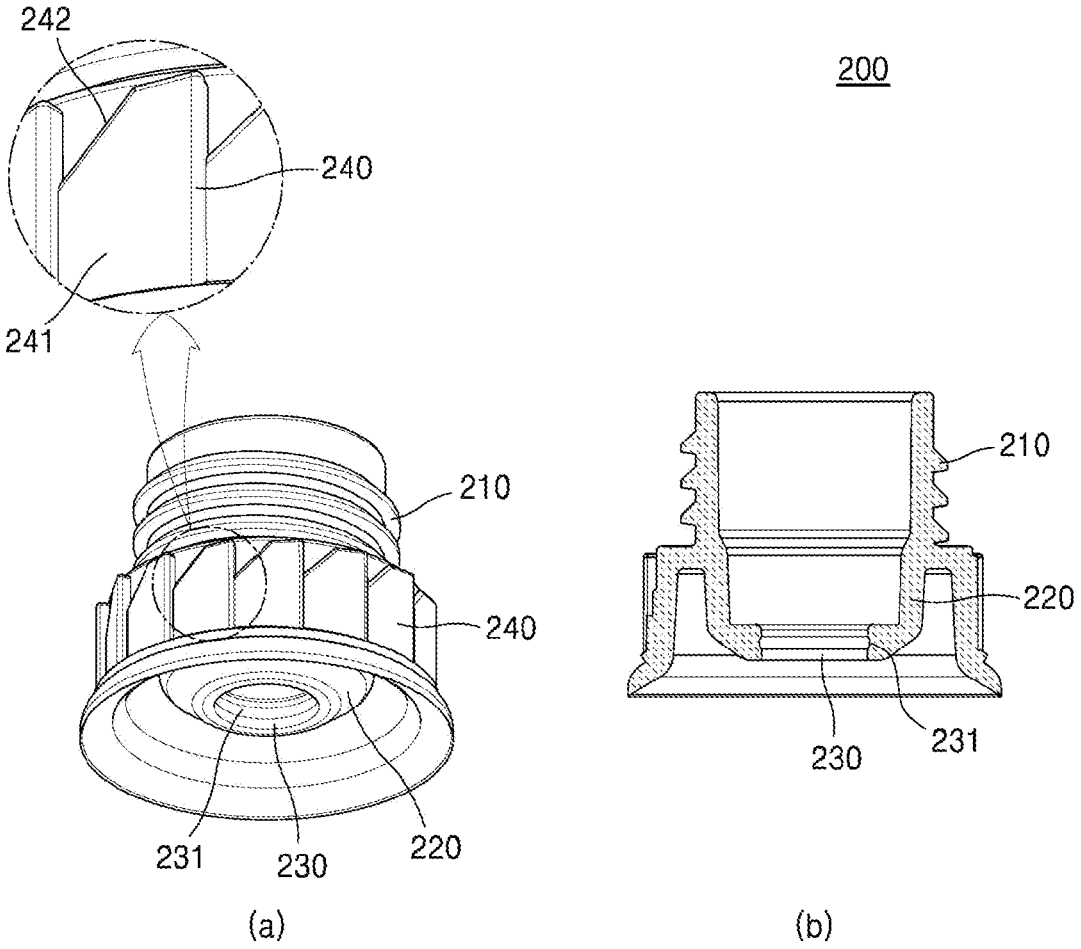
FIG. 3 is a perspective view and a cross-sectional view of a neck portion according to the embodiment of the present invention.
Figure 4:
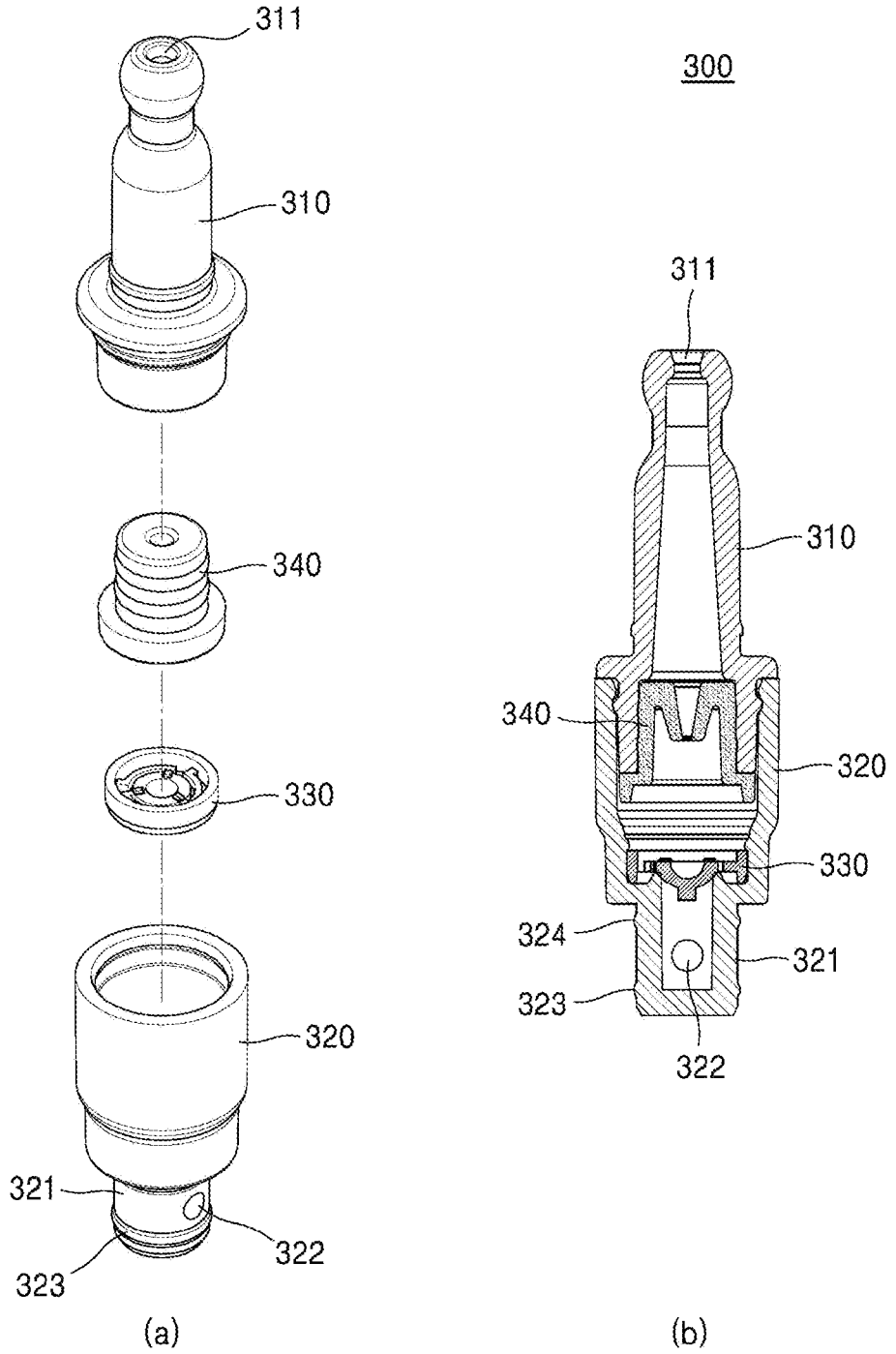
FIG. 4 is an exploded perspective view and a cross-sectional view of a discharge portion according to the embodiment of the present invention.
Figure 5:
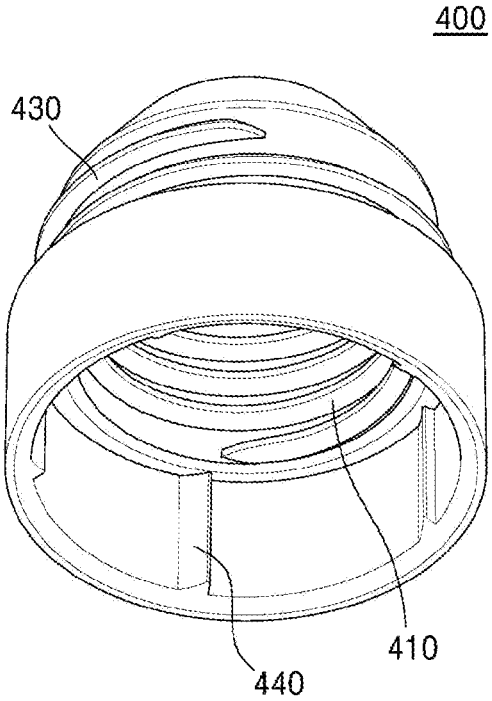
FIG. 5 is a perspective view of a shoulder portion according to the embodiment of the present invention.

FIG. 1 is a cross-sectional view of a content container according to an embodiment of the present invention, FIG. 2 is an exploded perspective view of the content container according to the embodiment of the present invention, FIG. 3 is a perspective view and a cross-sectional view of a neck portion according to the embodiment of the present invention, FIG. 4 is an exploded perspective view and a cross-sectional view of a discharge portion according to the embodiment of the present invention, and FIG. 5 is a perspective view of a shoulder portion according to the embodiment of the present invention.

Meanwhile, in FIG. 1, only the upper part of a container body 100 is illustrated, and in FIG. 2, the container body 100 is omitted for the convenience of description.

Referring to FIGS. 1 to 5, the content container 1000 may include a container body 100, a neck portion 200, a discharge portion 300, a shoulder portion 400, an overcap 500, and a stopper portion 600.

The container body 100 is open at the top and sealed at the bottom, and has an inner space for accommodating contents. The contents accommodated in the container body 100 can be discharged by a nozzle portion 310 of the discharge portion 300 and can be used by a user. Here, the contents may be in liquid or gel form, such as cosmetics, pharmaceuticals, or quasi-drugs like oral care products, but are not limited thereto, and may encompass all types of materials that can be discharged through the nozzle portion 310. Additionally, a tube type container body 100 is desirable, but it is exemplary, and various types of container bodies 100 such as bottles can be applied.

The neck portion 200 is coupled to the open top of the container body 100, and can connect other components of the content container 1000 to the container body 100. For example, the bottom of the neck portion 200 can be inserted into the open top of the container body 100, and can be attached to the inner top surface of the container body 100. Additionally, a first screw coupling portion 210 can be formed on the outer peripheral surface of the neck portion 200. The shoulder portion 400 can be detachably coupled to the neck portion 200 through the first screw coupling portion 210.

The neck portion 200 is open at the top to form an inner accommodation space, and an opening portion 230 can be formed at the inner bottom of the neck portion 200. For example, an inner peripheral edge 220 can be formed by extending from a point on the inner side of the neck portion 200 inwardly, and an opening portion 230 penetrating vertically can be formed at the center of the inner peripheral edge 220. When the neck portion 200 is coupled to the container body 100, the opening portion 230 can communicate with the interior of the container body 100. A coupling groove 231 can be formed on the inner surface of the opening portion 230. For example, the coupling groove 231 can be formed in a ring shape along the inner peripheral surface of the opening portion 230.

At least one rotation prevention protrusion 240 can be formed on the outer bottom surface of the neck portion 200. For example, a plurality of rotation prevention protrusions 240 can be formed along the outer peripheral surface of the bottom of the neck portion 200. The rotation prevention protrusion 240 can function to restrict the rotation direction of the shoulder portion 400 to a first direction together with a retaining protrusion 440 of the shoulder portion 400.

In an embodiment, the rotation prevention protrusion 240 may have a slope surface 241 formed on the outer surface thereof as the outward protrusion height increases in the first direction. Accordingly, the shoulder portion 400 can rotate in the first direction. However, when attempting to rotate in the second direction opposed to the first direction, the retaining protrusion 440 of the shoulder portion 400 may engage with the first direction end of the rotation prevention protrusion 240, thereby restricting the rotation in the second direction.

In an embodiment, a cut portion 242 may be formed on one side of the rotation prevention protrusion 240. For example, the cut portion 242 can be formed by diagonally cutting the upper portion of the end of the rotation prevention protrusion 240 in the second direction. As will be described with reference to FIG. 6, due to the cut portion 242, it may be easier to initially rotate the shoulder portion 400 in the first direction for unlocking the content container 1000.

At least a portion of the discharge portion 300 is accommodated inside the neck portion 200 through the open top of the neck portion 200, and the bottom of the discharge portion 300 is forcedly fit to the opening portion 230 of the neck portion 200 to seal the opening portion 230. Additionally, the discharge portion 300 can descend from the first position inside the neck portion 200 to the second position in response to the first-direction rotation of the shoulder portion 400 and/or the overcap 500.

In the locked state of the content container 1000, the discharge portion 300 can be positioned at the first position, and as the discharge portion 300 descends to the second position, the content container 1000 is unlocked, such that the contents can be discharged through the discharge portion 300.

The discharge portion 300 may include a nozzle portion 310, a housing portion 320, a check valve 330, and a control cap 340.

At least a portion of the nozzle portion 310 may protrude outward from the neck portion 200 and the shoulder portion 400 to discharge contents through an outlet 311 formed at the end thereof. The nozzle portion 310 may be configured, for example, as a pipette tube or a pipette shape having a hollow formed therein, but is not limited thereto.

The bottom of the nozzle portion 310 may be inserted and forcedly fit into the housing portion 320. Coupling protrusions and/or coupling grooves may be formed on the bottom outer surface of the nozzle portion 310 and/or the top inner surface of the housing portion 320 for coupling.

At least a portion of the housing portion 320 may be accommodated inside the neck portion 200 and the bottom of the housing portion 320 is forcedly fit to the opening portion 230 of the neck portion 200 to seal the opening portion 230. Additionally, when the discharge portion 300 descends to the second position, the housing portion 320 can communicate with the interior of the container body 100 to transfer the contents to the nozzle portion 310 connected to the top.

A scaling portion 321 may be formed on the bottom of the housing portion 320. For example, a portion of the housing portion 320, including the top, may be formed to correspond to the accommodation space of the neck portion 200, and the sealing portion 321 formed at the bottom may be formed to correspond to the opening portion 230. When the discharge portion 300 is inserted into the neck portion 200 up to the first position, the housing portion 320 may be accommodated inside the accommodation space of the neck portion 200, and the sealing portion 321 may be inserted into the opening portion 230 to seal the opening portion 230. In this case, the top of the housing portion 320 is comes into close contact with the inner wall of the neck portion 200, such that the neck portion 200 and the container body 100 can be doubly sealed by the housing portion 320.

At least one communication hole 322 may be formed in the side of the sealing portion 321 to penetrate through the inside. When the discharge portion 300 is in the first position (locked state), the communication hole 322 is positioned above the opening portion 230, and as the discharge portion 300 descends to the second position (unlocked state), the communication hole 322 moves downward below the opening portion 230 to be exposed into the container body 100.

In an embodiment, on the side of the sealing portion 321, at least one first coupling protrusion 323 and at least one second coupling protrusion 324 may be respectively formed on the bottom and the top of the communication hole 322 to be spaced apart from each other. When the discharge portion 300 is in the first position, the first coupling protrusion 323 may be coupled to the coupling groove 231 of the opening portion 230. As the discharge portion 300 descends to the second position, the first coupling protrusion 323 may be separated from the coupling groove 231, and the second coupling protrusion 324 may be coupled to the coupling groove 231. Through the coupling of the first and second coupling protrusions 323 and 324 and the coupling groove 231, the sealing performance can be improved further.

The check valve 330 may be positioned at the top of the sealing portion 321 to seal the inner bottom of the housing portion 320. When the user presses the container body 100 in the unlocked state of the content container 1000, the check valve 330 is opened due to the pressure of the contents flowing into the communication hole 322 to allow the contents to be transferred to the nozzle portion 310.

The control cap 340 may be forcedly fit into the bottom of the nozzle portion 310 and may be positioned inside the housing portion 320. The control cap 340 can control the amount and/or speed of the contents transferred to the nozzle portion 310 when pressure is applied to the container body 100. For this purpose, a predetermined shape of content movement hole (no reference numeral) may be formed penetratingly in the control cap 340. For example, the content movement hole may be configured to have an inner diameter increasing in the direction of the outlet 311.

The shoulder portion 400 can be coupled to the outer side of the neck portion 200 to fix the discharge portion 300 to the neck portion 200. For this purpose, a second screw coupling portion 410 corresponding to the first screw coupling portion 210 of the neck portion 200 may be formed on the inner peripheral surface of the shoulder portion 400, and a through hole through which the nozzle portion 310 passes may be formed at the top of the shoulder portion 400, and a pressing edge 420 may protrude downward along the perimeter of the through hole.

For example, during assembly of the shoulder portion 400, when the shoulder portion 400 is rotated in the first direction, the shoulder portion 400 can be coupled to the neck portion 200, and the pressing edge 420 can press against the perimeter of the nozzle portion 310 protruding outward from the neck portion 200, thereby fixing the discharge portion 300.

A third screw coupling portion 430 may be formed on the outer surface of the shoulder portion 400. Accordingly, an overcap 500 may be detachably coupled to the upper side of the shoulder portion 400.

The shoulder portion 400 can be rotated in the first direction by external force, so the discharge portion 300 is pressed to lower the discharge portion 300 from the first position to the second position.

At least one retaining protrusion 440 may be formed on the inner bottom surface of the shoulder portion 400. For example, the retaining protrusions 440 may be formed at predetermined intervals along the inner peripheral surface of the bottom of the shoulder portion 400. As described above, the retaining protrusions 440, together with the rotation prevention protrusions 240 of the neck portion 200, can restrict the second-direction rotation of the shoulder portion 400.

In an embodiment, since the internal protrusion height of the retaining protrusion 440 gradually increases in the second direction, a slope surface corresponding to the slope surface 241 of the rotation prevention protrusion 240 may be formed on the outer surface of the retaining protrusion 440. When the shoulder portion 400 is rotated in the second direction, the second-direction end of the retaining protrusion 440 may be caught to the first-direction end of the rotation prevention protrusion 240 to restrict the second-direction rotation of the shoulder portion 400.

The overcap 500 can be detachably coupled to the shoulder portion 400 to cover the nozzle portion 310 from the outside to shield the nozzle portion 310. For this purpose, a fourth screw coupling portion 510 corresponding to the third screw coupling portion 430 of the shoulder portion 400 may be formed on the inner bottom surface of the overcap 500. When the overcap 500 is rotated in the first direction, the overcap 500 can be coupled to the shoulder portion 400, and when the overcap 500 is rotated in the second direction, the overcap 500 can be separated from the shoulder portion 400.

A nozzle tip receiving portion 520, in which the end of the nozzle portion 310 having the outlet 311 is accommodated, can be formed on the inner top surface of the overcap 500. At least a portion of the nozzle tip receiving portion 520 is formed to be recessed to correspond to the shape of the end of the nozzle portion 310. When the overcap 500 is coupled, the end of the nozzle portion 310 can be inserted into the nozzle tip receiving portion 520 to seal (or shield) the outlet 311.

In the state in which the overcap 500 is fully coupled to the shoulder portion 400, when an external force is applied to the overcap 500 to rotate the overcap 500 in the first direction, the shoulder portion 400 can receive the force from the overcap 500 and rotate together with the overcap 500 in the first direction.

The stopper portion 600 is formed in a ring shape opened at one side, is coupled to cover the bottom of the neck portion 200 (for example, the portion where the rotation prevention protrusion 240 is formed), and can be placed between the neck portion 200 and the shoulder portion 400. By supporting the bottom of the shoulder portion 400, the stopper portion 600 can prevent the locking state of the content container 1000 from being released by the descent of the shoulder portion 400. For example, to make the discharge portion 300 located at the first position (namely, to make the first coupling protrusion 323 of the discharge portion 300 coupled to the coupling groove 231 of the neck portion 200), only a portion of the second screw coupling portion 410 of the shoulder portion 400 is coupled to the first screw coupling portion 210 of the neck portion 200, and the bottom of the shoulder portion 400 is supported by the stopper portion 600, thereby preventing the descent by the first-direction rotation of the shoulder portion 400.

At least one second retaining protrusion 610 may be formed on the inner peripheral surface of the stopper portion 600. When the second retaining protrusion 610 is caught to the rotation prevention protrusion 240 of the neck portion 200, the rotation of the stopper portion 600 can be prevented.

Figure 6:
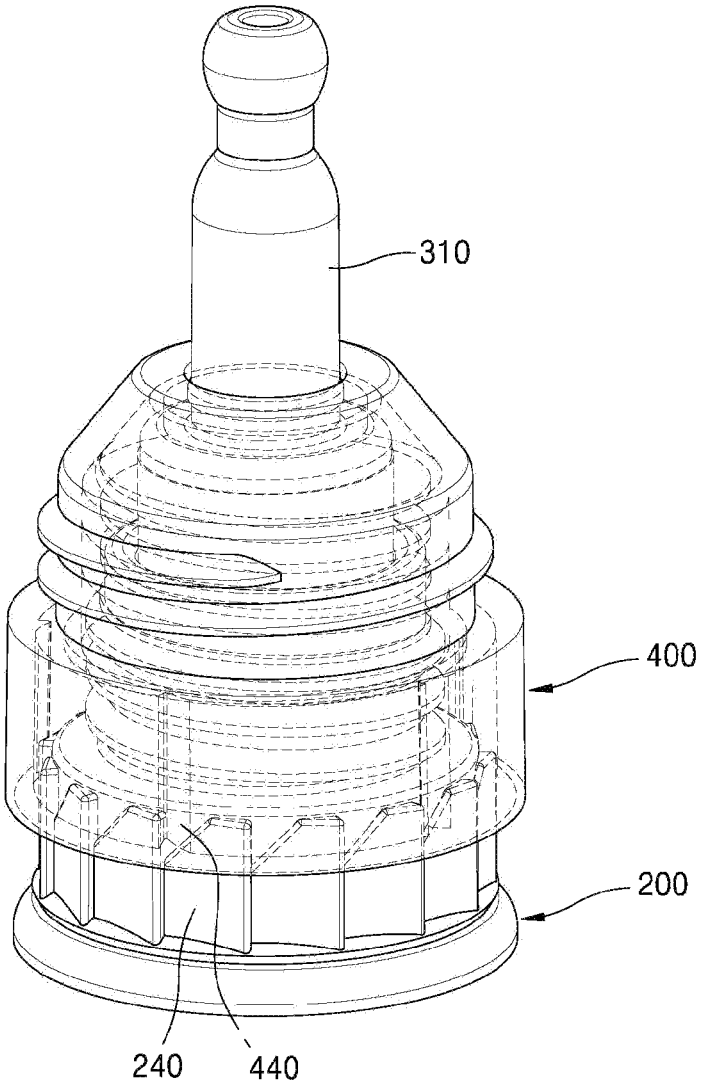
FIG. 6 is a diagram illustrating the coupling relationship of the content container according to the embodiment of the present invention.

FIG. 6 is a diagram illustrating the coupling relationship of the content container according to the embodiment of the present invention.

More specifically, FIG. 6 illustrates the coupling relationship of the neck portion 200, the discharge portion 300, and the shoulder portion 400 in the locked state of the content container 1000.

In the locked state before the shoulder portion 400 and the discharge portion 300 descend, the bottom of the shoulder portion 400 can be maintained at a predetermined distance from the bottom of the neck portion 200 or the top of the container body 100.

At this time, as illustrated in FIG. 6, the bottom of the retaining protrusion 440 of the shoulder portion 400 can be positioned on a space formed between two adjacent rotation prevention protrusions 240 by the cut portion 242.

When an external force is applied to rotate the shoulder portion 400 in the second direction in the locked state of the content container 1000, the bottom of the retaining protrusion 440 is caught to the top of the rotation prevention protrusion 240, thereby preventing the rotation in the second direction. On the other hand, when the user rotates the shoulder portion 400 in the first direction for unlocking, the friction between the shoulder portion 400 and the rotation prevention protrusion 240 is reduced due to the presence of the cut portion 242, so the user can easily rotate the shoulder portion 400 in the first direction to convert the content container 1000 into the unlocked state.

Figure 7:
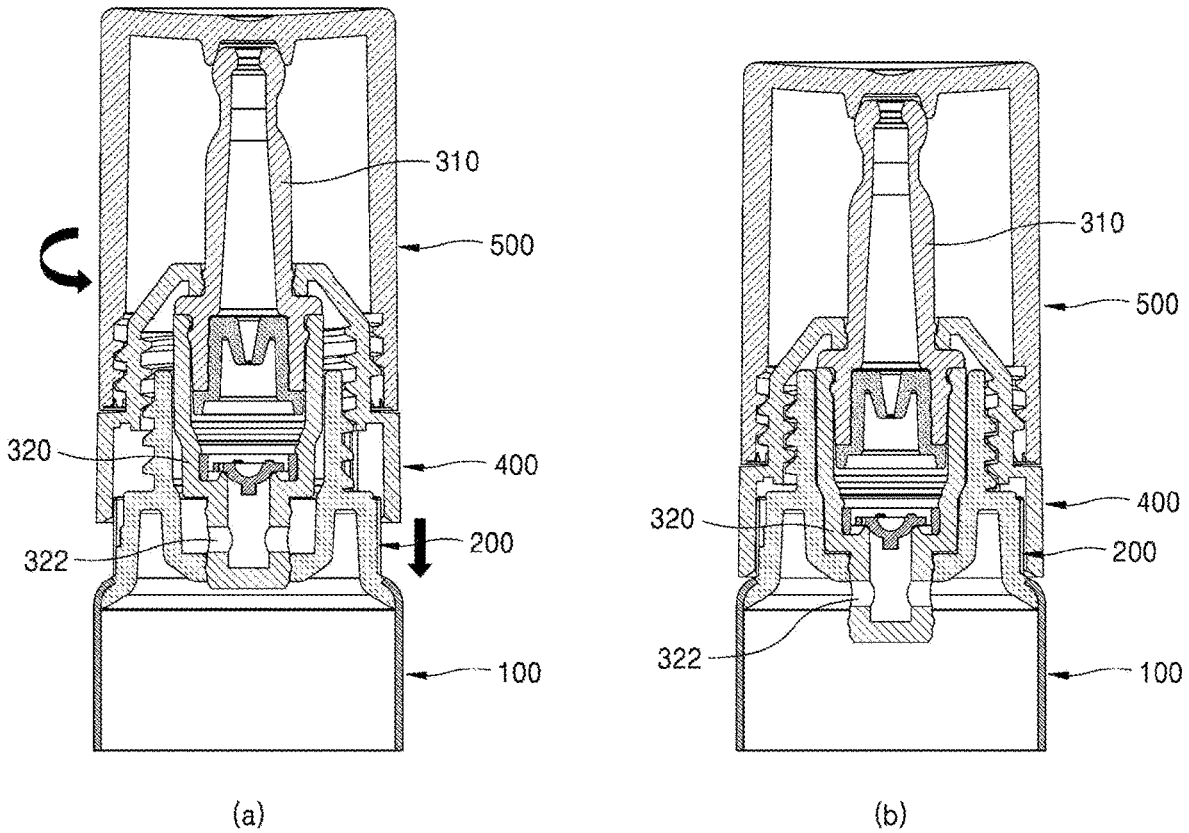
FIGS. 7 and 8 illustrate an exemplary operation of the content container according to the embodiment of the present invention.
Figure 8:
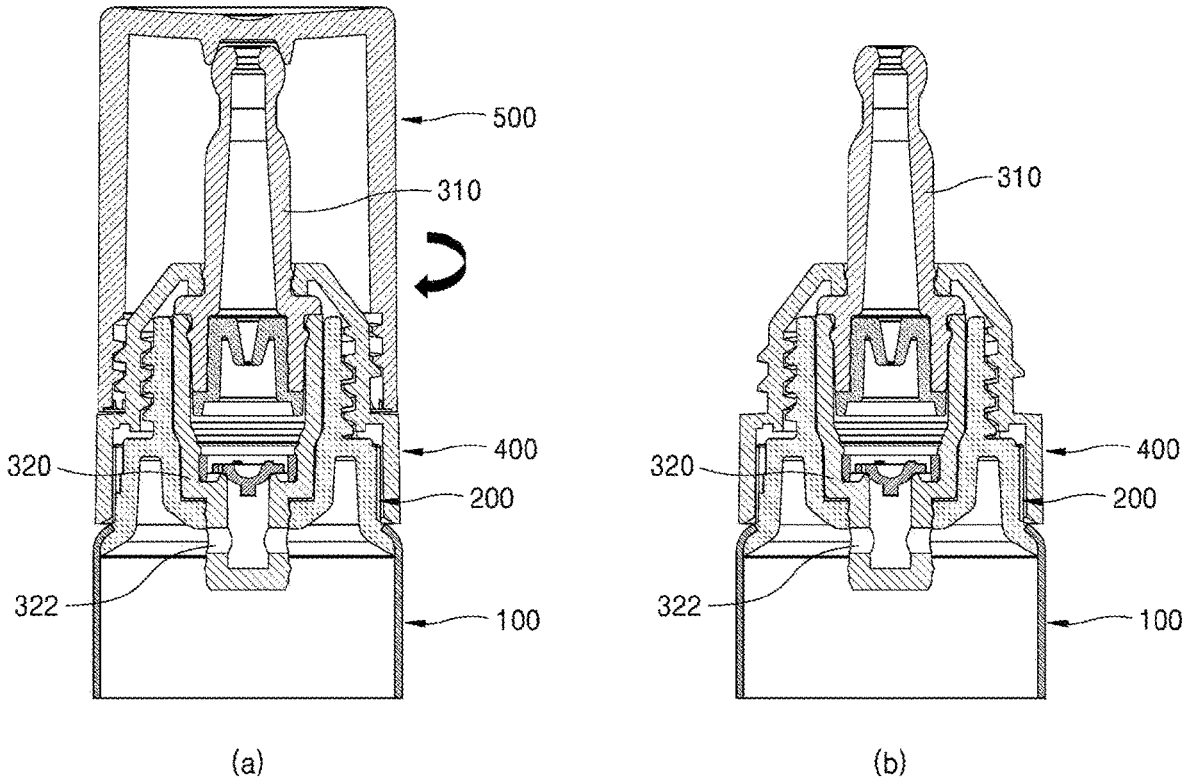

FIGS. 7 and 8 illustrate an exemplary operation of the content container according to the embodiment of the present invention.

Referring to FIG. 7, in the locked state of the content container 1000, the communication hole 322 of the discharge portion 300 is positioned above the opening portion 230 to be blocked from the inside of the container body 100, and the opening portion 230 can be completely sealed by the bottom of the housing portion 320.

When the user removes the stopper portion 600 and rotates the overcap 500 in the first direction, the content container 1000 can be converted into the unlocked state. That is, the shoulder portion 400 descends while rotating in the first direction due to the rotation of the overcap 500, and the discharge portion 300 can descend to the second position. As a result, the communication hole 322 is positioned below the opening portion 230 to communicate with the inside of the container body 100, such that the content container 1000 is unlocked.

Continuously, referring to FIG. 8, the user can remove the overcap 500 from the shoulder portion 400 by rotating the overcap 500 in the second direction. That is, when rotating the overcap 500 in the second direction, the shoulder portion 400 does not rotate with the overcap 500 by the rotation prevention protrusion 240 and is fixed to the neck portion 200, so only the overcap 500 can be removed from the shoulder portion 400.

Subsequently, when the user presses the container body 100, the contents can be introduced into the communication hole 322, pass through the inside of the housing portion 320, and then, be discharged through the nozzle portion 310.

As described above, the optimal embodiments has been disclosed in the drawings and the specification. Specific terms have been used herein for descriptive purposes, not for purposes of limitation of meanings or to limit the scope of the invention as set forth in the claims. Therefore, it would be understood by those skilled in the art that various modifications and equivalent embodiments are possible from the present disclosure. Accordingly, the true scope of protection of the present disclosure should be determined by the technical concept of the attached claims.

The invention claimed is:

1. A content container comprising:

a container body accommodating contents;

a neck portion formed on a top of the container body and having an opening portion formed therein to communicate with an inside of the container body;

a discharge portion, of which at least a portion is accommodated in the neck portion to seal the opening portion, and which has a nozzle portion for discharging the contents; and a shoulder portion coupled to an outer side of the neck portion to be coupled with the discharge portion, wherein the discharge portion has at least one communication hole formed at a bottom of the discharge portion to transfer the contents of the content container to the nozzle portion, wherein when the shoulder portion rotates in a first direction, the discharge portion descends with the shoulder portion, and wherein when the discharge portion descends from a first position to a second position, the communication hole is exposed to the inside of the container body to permit transfer of the contents in the container body to the nozzle portion via the communication hole.

2. The content container according to claim 1, wherein the communication hole is positioned above the opening portion in the first position of the discharge portion to be blocked from the inside of the content container, and when the discharge portion descends to the second position, the communication hole is positioned below the opening portion to communicate with the inside of the container body.

3. The content container according to claim 2, wherein on an outer side of the bottom of the discharge portion, at least one first coupling protrusion and at least one second coupling protrusion are respectively formed on the bottom and the top of the communication hole to be spaced apart from each other, and at least one coupling groove corresponding to the at least one first coupling protrusion and the at least one second coupling protrusion is formed on an inner surface of the opening portion, wherein the at least one first coupling protrusion is coupled to the at least one coupling groove in the first position of the discharge portion such that the communication hole is located above the opening portion, and wherein the at least one second coupling protrusion is coupled to the at least one coupling groove in the second position of the discharge portion such that the communication hole is located below the opening portion.

4. The content container according to claim 1, wherein at least one rotation prevention protrusion is formed on an outer surface of a bottom of the neck portion to prevent the shoulder portion from rotating in a second direction opposite to the first direction.

5. The content container according to claim 4, further comprising:

an overcap coupled to the top of the shoulder portion to cover and shield the nozzle portion, wherein when the overcap is rotated in the first direction, the shoulder portion rotates with the overcap in the first direction.

6. The content container according to claim 5, wherein when the overcap is rotated in the second direction, the overcap is separated from the shoulder portion.

7. The content container according to claim 4, wherein at least one retaining protrusion is formed on an inner bottom surface of the shoulder portion, wherein the at least one rotation prevention protrusion includes a slope surface on an outer side thereof as a protrusion height of the rotation prevention protrusion increases in the first direction, and wherein when the shoulder portion is rotated in the second direction, the at least one retaining protrusion is caught by an end of the rotation prevention protrusion in the first direction, thereby preventing rotation of the shoulder portion in the second direction.

8. The content container according to claim 7, wherein the retaining protrusion is formed to have a protrusion height that increases in the second direction.

9. The content container according to claim 1, further comprising:

a stopper portion disposed between the neck portion and the shoulder portion to cover the neck portion, thereby preventing descent of the shoulder portion due to rotation in the first direction.

* * * * *